US007682191B2

(12) United States Patent
Iwahori et al.

(10) Patent No.: US 7,682,191 B2
(45) Date of Patent: Mar. 23, 2010

(54) CONNECTOR

(75) Inventors: Yoshihiro Iwahori, Shizuoka-ken (JP); Ryo Sawada, Atsugi (JP); Takahiro Yoneda, Atsugi (JP)

(73) Assignee: Yazaki Corporation, Tokyo (JP)

( * ) Notice: Subject to any disclaimer, the term of this patent is extended or adjusted under 35 U.S.C. 154(b) by 15 days.

(21) Appl. No.: 11/837,120

(22) Filed: Aug. 10, 2007

(65) Prior Publication Data

US 2009/0042438 A1 Feb. 12, 2009

(51) Int. Cl.
*H01R 13/422* (2006.01)

(52) U.S. Cl. ..... 439/595

(58) Field of Classification Search ..... 439/752, 439/595, 358, 489
See application file for complete search history.

(56) References Cited

U.S. PATENT DOCUMENTS 5,944,558 A * 8/1999 Iwahori ..... 439/595

FOREIGN PATENT DOCUMENTS

JP 9-106847 4/1997
JP 2004-241155 8/2004

* cited by examiner

*Primary Examiner*—Alexander Gilman
(74) *Attorney, Agent, or Firm*—Finnegan, Henderson, Farabow, Garrett & Dunner, L.L.P.

(57) ABSTRACT

A connector includes: a housing main body including a rib extending frontward; a front holder fitted into the housing main body from the front, and capable of moving from a temporary locking position to a permanent locking position, and the front holder including a through-hole into which the rib is inserted; means for temporarily locking the front holder; and means for permanently locking the front holder. The rib is long enough for a front end of the rib to agree with, or jut out from, a rear end surface of the front holder which is located rearward in an insertion direction of the front holder while the front holder is held in the temporary locking position. The housing main body includes bendable lances for locking their corresponding terminals inserted into the housing main body. The front holder includes lance pressing parts restricting the bends of the corresponding bendable lances.

2 Claims, 7 Drawing Sheets

CONNECTOR

BACKGROUND OF THE INVENTION

1. Field of the Invention

The present invention relates to connectors designed to double lock a terminal to a housing by use of a front holder.

2. Description of the Related Art

Connectors of this type are known from Japanese Patent Application Lad-open Publication Nos. Hei. 9-106847 ad 2004-241155.

FIGS. 1 and 2 show a connector of this type and each figure shows one connector (male connector) 101 of a pair of connectors fitted to each other. A housing 101A of this connector 101 includes: a housing main body 110 including a cylindrical section 111 for accommodating terminals 130, and a hood section 112 arranged around the outer circumference of the cylindrical section 111; and a front holder 120 to be fitted into the front side of the outer circumferential portion of the cylindrical section 111 from the front.

Terminal accommodating chambers 113 are formed inside the cylindrical section 111. A bendable lance 114 is provided to a part of the circumferential wall of each of the terminal accommodating chambers 113. Thus, the lance 114 locks a corresponding one of the terminals (female terminals) 130 which has been inserted into a corresponding one of the terminal accommodating chambers 113 from the rear of the housing main body 110 in order that the terminal can be stopped from coming out of the terminal accommodating chamber 113.

A bend allowing space 115 for allowing the bendable lance 114 to bend in response to the insertion of the terminal 130 is secured outside the bendable lance 114.

The front holder 120 is provided in a way that the front holder 120 is capable of being inserted into the housing main body 110 from a temporary locking position closer to the front (a position shown in FIG. 1) to a permanent locking position away from the front (a position shown in FIG. 2). Temporary locking means and permanent locking means (not illustrated) are configured respectively to temporarily lock the font holder 120 in the temporary looking position and to permanently lock the front holder 120 in the permanent locking position. These two means are provided between the housing main body 110 into which the front holder 120 is capable of being inserted and the front holder 120.

While the front holder 120 is in the temporary locking position, the bendable lances 114 are allowed to bend in the respective bend allowing spaces 115. Thus, the bendable lances 114 are capable of looking the respective terminals 130 which have been inserted into the housing main body 110 from the rear, and of hence preventing the respective terminals 130 from coming out of the housing main body 110.

As shown in FIG. 2, the front holder 120 is provided with lance pressing parts 121. When the front holder 120 is moved from the temporary locking position to the permanent locking position with the terminals 130 locked by their respective bendable lances 114, the corresponding lance pressing parts 121 enter their respective bend allowing spaces 115, and press the respective bendable lances 114 toward the terminals 130, thus prohibiting the bendable lances 114 from bending. As a result the terminals are double locked.

A rear end wall 122 of the font holder 120 which is located at the rear end in a direction in which the front holder 120 is inserted into the housing main body 110 is provided with terminal inserting holes 123 into which corresponding terminals (male terminals) of the connector pared with the connector 101 are inserted.

In a case when one is going to assemble the connector 101 with the housing main body 110, as shown in FIG. 1, first of all, the fits the front holder 120 to the front end portion of the cylindrical section 111 of the housing main body 110, and locks the front holder 120 to the housing main body 110 by use of the temporary locking means. While the front holder 120 is in this condition, the front holder 120 is prevented from being inserted into the housing main body 110 any more, and is held in the temporary locking position.

Subsequently, he insets terminals 130, to which corresponding cables are connected, into the respective terminal accommodating chambers 113 in the cylindrical section 111. At this time, the this 130 are temporarily looked by the corresponding bendable lances 114 in the cylindrical section 111 from the rear of the housing main body 110. In this state, the front holder 120 is inserted to the permanent locking position from the temporary looking position as shown in FIG. 2. As a consequent the front holder 120 is permanently locked to the housing main body 110 by the permanent locking means. At this time, the lance pressing parts 121 of the front holder 120 enter the respective bend allowing spaces 115 for the corresponding bendable lances 114. This checks the bendable lances 114 from deforming due to their respective bends. Thereby, the terminals 130 are double locked.

It should be noted that the connector 101 as shown in FIG. 1 is often handled in an assembled condition where the front holder 120 is temporarily locked to the housing main body 110. While the front holder 120 is in this temporary locking condition, the front holder 120 juts out from the front end 110*a* of the housing main body 110. For this reason, for example, when the front holder 120 hits another article or falls during its shipment or the like before the terminals are not attached thereto, the front holder 120 is inadvertently inserted for the temporary locking position to the permanent locking position in some cases. Once the front holder 120 is inserted up to the permanent locking position (the position shown in FIG. 2), work for inserting, the terminals 130 thereto can not be performed. For this reason, the front holder 120 has to be returned to the temporary locking position through releasing the front holder 120 from the permanent lock by taking some measures. This work is extremely troublesome.

With this taken into consideration, the following measures have been examined.

One measure is to forwardly extend out the front end of the hood section from the housing main body and thereby cover the front holder with the extended hood section (see Japanese Patent Application Lad-open Publication No. 2004-241155). The extension of the hood section bring about a problem that the connector is accordingly construed in a larger scale. In addition, in a case where the hood section is intended to prevent to front holder from being inserted into the housing main body, the expected effect of preventing the front holder from being inadvertently inserted thereto is lost if the opening of the hood section is too large. For this reason, the opening of the hood section has to be narrower. As a result, the extended hood section is inadequate for a multi-polar connector.

The other measure is to set stronger a holding power with which to temporarily lock the front holder. If, however, the holding power with which to temporarily lock the front holder is set stronger, a stronger force is needed for moving the front holder to the permanent locking position after the terminals are inserted thereto. This deteriorates the workability.

SUMMARY OF THE INVENTION

The present invention has been made with the above-described situations taken into consideration. An object of the present invention is to provide a connector which prevents a front holder existing in a temporary locking position from being inserted to a permanent locking position easily while satisfying a condition that the connector can cope with its miniaturized and multi-polar construction, and a condition that work for permanently locking the front holder can be easily carried out.

An aspect of the connector according to the present invention is to provide a connector including: a housing main body into which terminals are inserted from a rear of the housing main body, and which includes a rib extending frontward, a front holder designed to be fitted into the housing main body from a front of the housing main body, and designed to be capable of moving from a temporary locking position, closer to the front of the housing main body, to a permanent locking position away from the front of the housing main body, and the front holder including a through-hole into which the rib is capable of being inserted; temporary locking means, provided between the housing main body and the front holder, and configured to temporarily lock the front holder in the temporary locking position; permanent locking means configured to permanently look the front holder in the permanent locking position; bendable lances provided to one of the housing main body and the front holder; and lance pressing parts provided to other of the housing main body and the front holder. In the case of the connector, with the front holder existing in the temporary locking position, the bendable lances lock the corresponding terminals which have been inserted into the housing main body from the rear thereof; when the front holder is pressed inward from the temporary locking position to the permanent locking position with terminals locked by the corresponding bendable lances, the lance pressing parts enter corresponding bend allowing spaces of the bendable lances, and prohibit the corresponding bendable lances from bending, thereby double locking the terminals; and the rib is long enough for an front end of the rib to agree with, or jut out from, a rear end surface of the front holder which is located rearward in a direction in which the front holder is inserted into while the front holder is being held in the temporary locking position.

Even in a case where, for example, an article hits the rear end surface of the front holder so that a force works on the front holder in the same direction auto front holder is inserted thereto while the front holder is being temporarily locked in the front end of the housing, the foregoing configuration makes it possible for the force to be received by the front end of the rib provided in a protruding manner to the housing main body. This makes it possible to prevent the front holder from being inadvertently moved from the temporary locking position to the permanent locking position.

In addition to the foregoing configuration, the rib and the trough-hole may be provided with their respective guiding surfaces which slidably contact each other, and which guide the insertion of the front holder.

The foregoing configuration improves the workability with which the front holder is inserted from the temporary locking position to the permanent locking position. Moreover, because the guiding surfaces stably contact each other, it is possible to prevent the front holder and the housing main body from being shaky.

In addition to the foregoing configuration, it is desirable that the connector should include a hood, provided around the outer circumference of the housing main body, for guiding the insertion of a counterpart connector of the connector, and that the rib should jut out from the front end of the hood forward of the housing main body.

This configuration makes it possible to shorten the length of the hood, and to make contributions to cons the connector in a smaller scale.

Additionally, it is desirable that in the case of the connector, the housing main body should include multiple terminal accommodating sections for accommodating their respective groups of terminals which are different in specification from one group to another, and that the rib should be arranged between the terminal accommodating sections in order to physically separate the terminal accommodating sections.

The foregoing configuration helps to prevent a leakage from occurring between terminals which are different in specification from each other. For example, the arranging of the rib between the terminals for the power supply system and the terminals for the signal systems makes it possible to prevent a leakage from occurring between the terminals for the power supply system and the terminals for the signal system while the connectors are fitted to each other.

DETAILED DESCRIPTION OF THE EMBODIMENT

Figure 1:
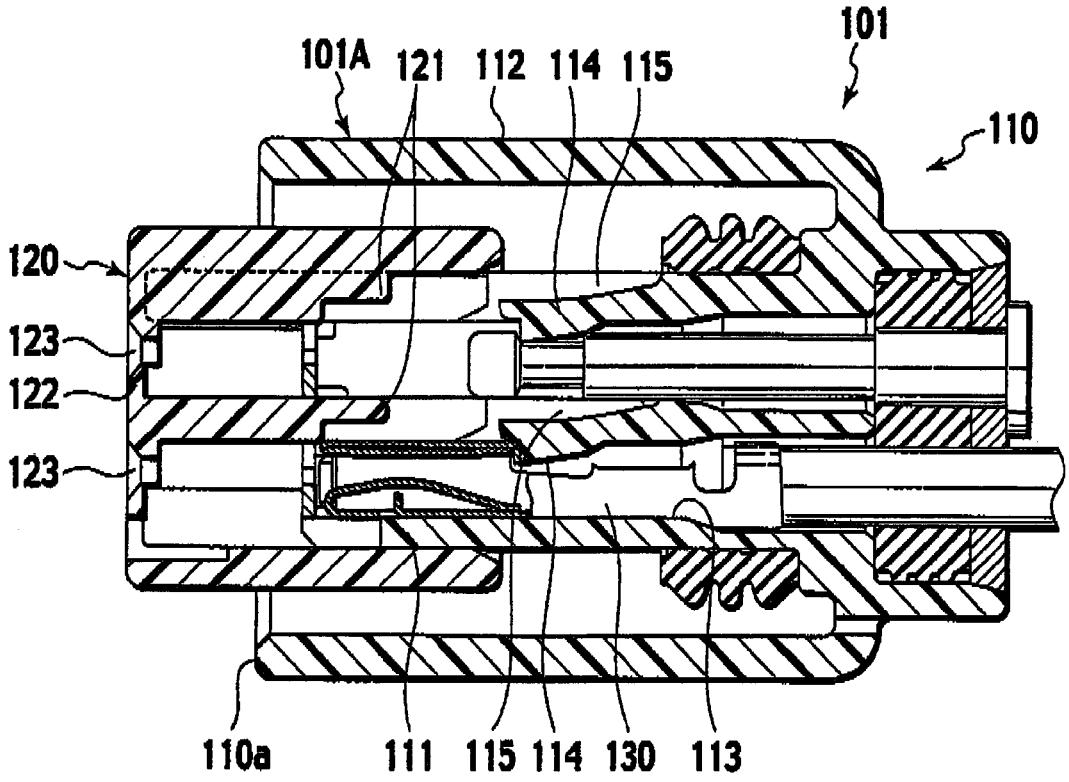
FIG. 1 is a side cross-sectional view showing a configuration of a conventional type of connector, in which a front holder is being held in a temporary locking position.

Descriptions will be provided hereinafter for an embodiment of the present invention with reference to the drawings.

FIGS. 3 to 7 show a connector according to the embodiment. This connector 1 is a connector (male connector) constituting a pair of connectors fitted to each other. A housing 1A of this connector 1 is configured of: a housing main body 10 including a cylindrical section 11 for accommodating terminals (their illustrations are omitted) and a hood section 12 arranged around the outer circumference of the cylindrical section 11; and a front holder 20 to be fitted into the front side of the outer circumferential portion of the cylindrical section 11 from the front from the housing main body 10.

Terminal accommodating chambers (their illustrations are omitted) are formed inside the cylindrical section 11 of the housing main body 10. A bendable lance (its illustration is omitted) is provided to a part of the circumferential wall of each of the terminal accommodating chambers. The bendable lance is that for locking a corresponding one of the terminals (female terminals) which has been inserted into a corresponding one of the terminal accommodating chambers from the rear of the housing main body, and for thus preventing the terminal from coming out of the terminal accommodating chamber. A bend allowing space for allowing the bendable lance to bend in response to the insertion of the terminal is formed outside the bendable lance.

Figure 5:
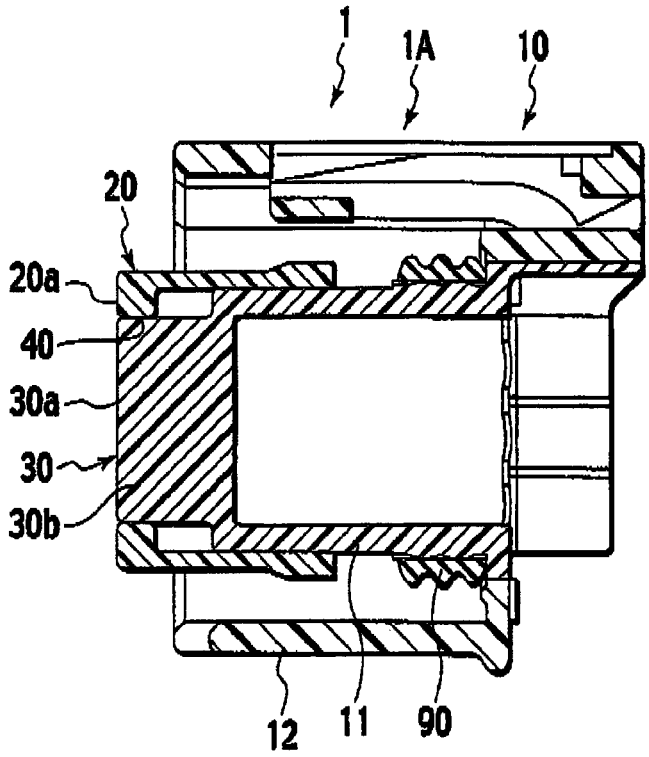
FIG. 5 is a cross-sectional view of the connector as shown in FIG. 4, in which the front holder is fitted thereto up to the temporary locking position.
Figure 6:
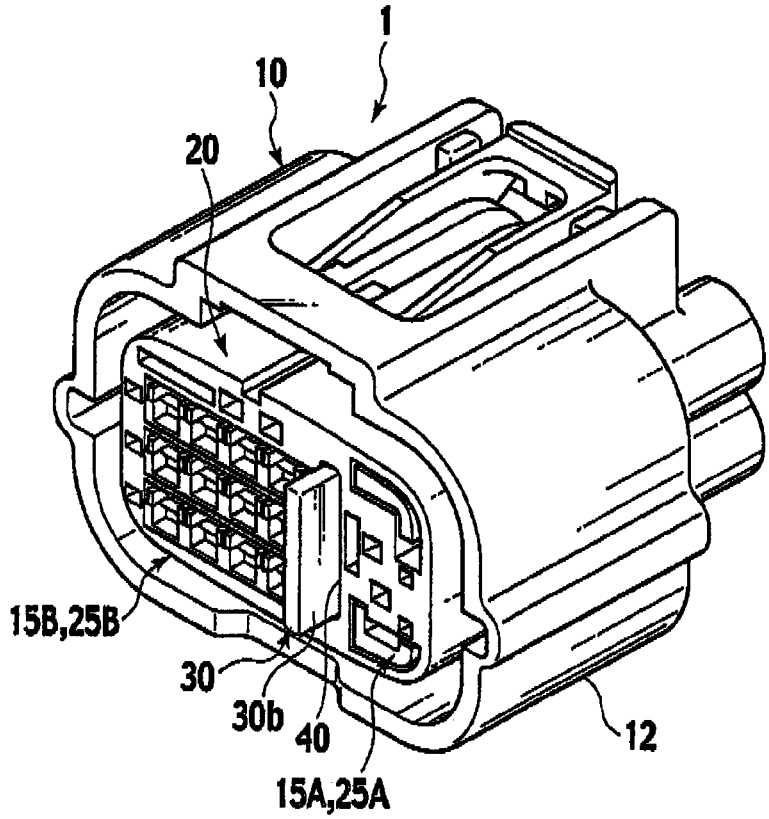
FIG. 6 is a perspective view of the connector, in which the front holder is fitted thereto up to a permanent locking position.
Figure 7:
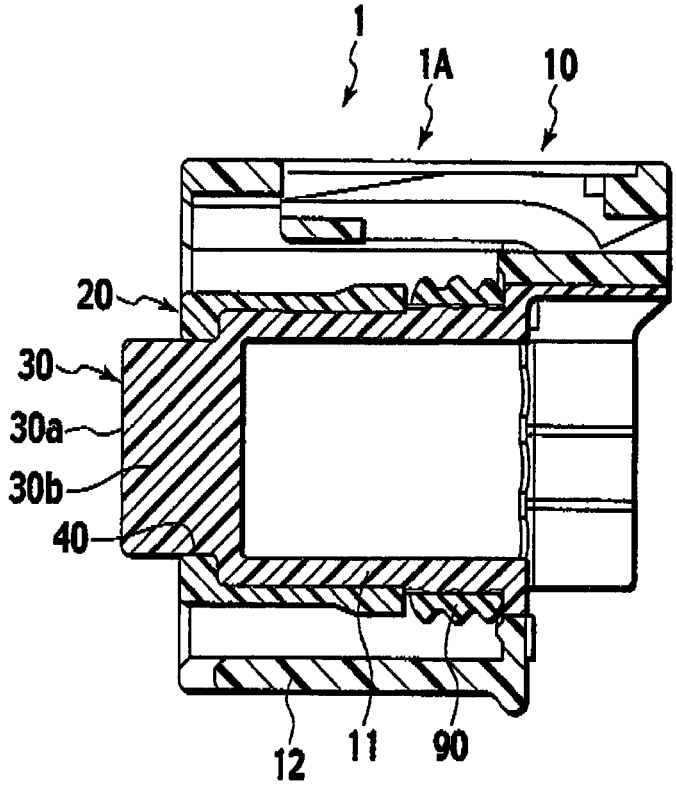
FIG. 7 is a cross-sectional view of the connector as shown in FIG. 6, in which the front holder is fitted thereto up to the permanent locking position.

The front holder 20 is capable of being inserted into the housing main body 10 from a temporary locking position closer to the front (a position shown in FIGS. 4 and 5) to a permanent locking position away from the front (a position shown in FIGS. 6 and 7). Temporary locking means (not illustrated) configured to temporarily lock the front holder 20 in the temporary locking position and permanent locking means (not illustrated) configured to permanently lock the front holder 120 in the permanent locking position are provided between the housing main body 10 and the front holder 20.

Figure 2:
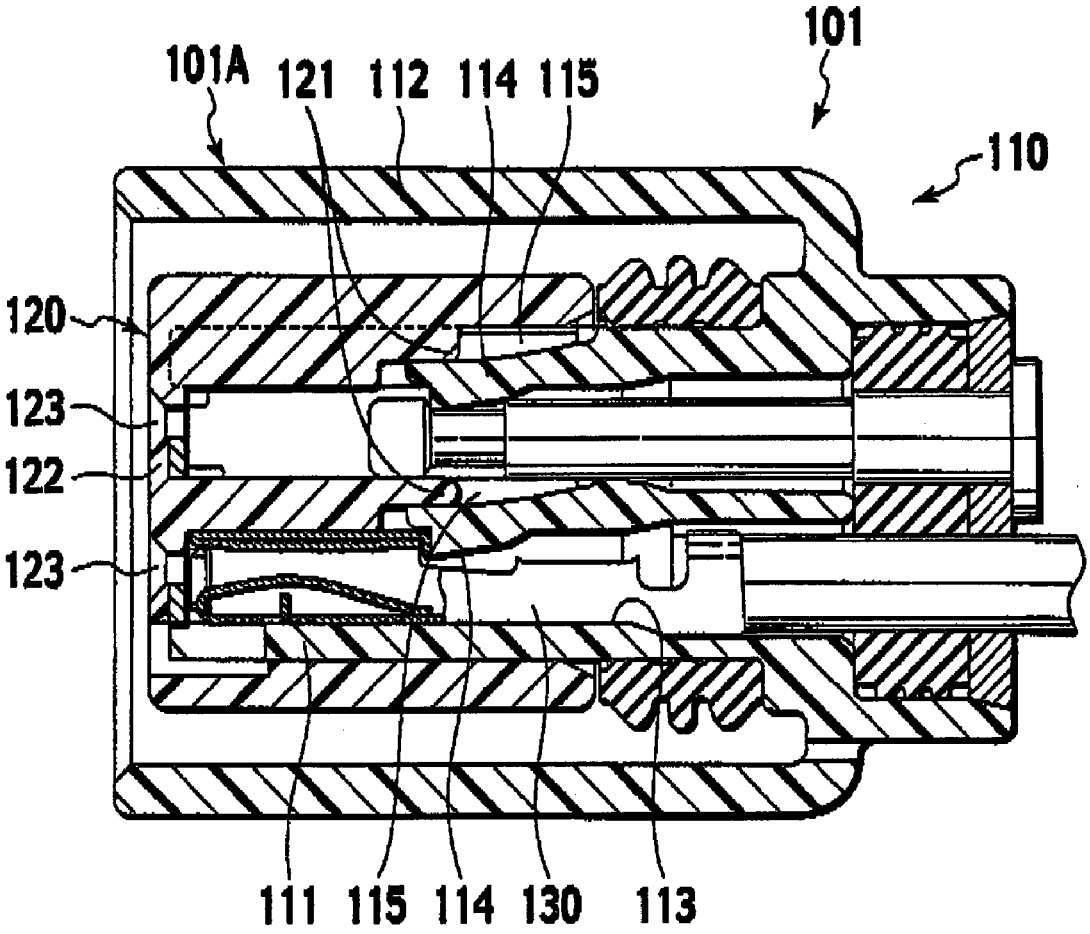
FIG. 2 is a side cross-sectional view of the configuration of the conventional type of connector, in which the front holder is inserted thereto up to a permanent locking position.
Figure 3:
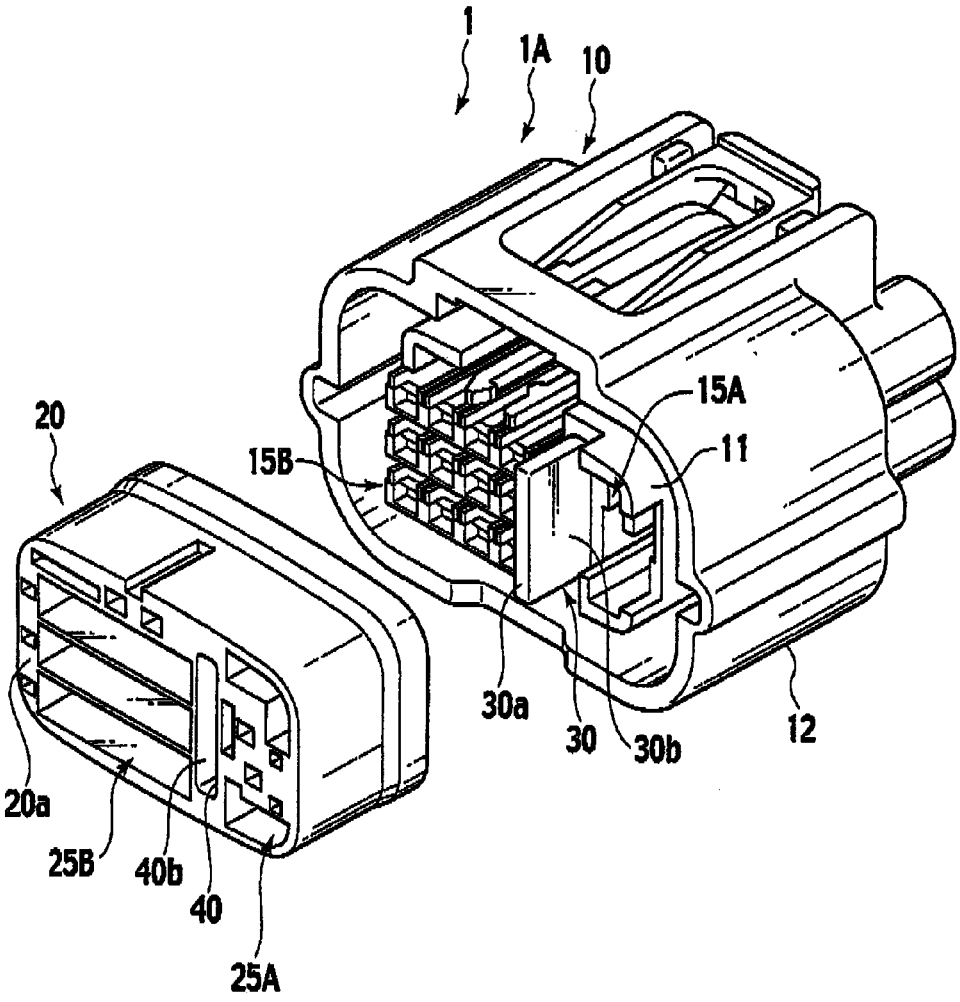
FIG. 3 is an exploded perspective view of a connector (male connector) according to an embodiment of the present invention.

While the front holder 20 is in the temporary locking position, the bendable lances are capable of bending in the respective bend allowing spaces. Thus, the bendable lances are capable of locking the respective terminals which have been inserted into the housing main body 10 from the rear, and of hence preventing the respective terminals from coming out of the housing main body 10. On the other hand, as shown in FIGS. 6 and 7, the front holder 20 is provided with lance pressing parts (not illustrated). When the front holder 20 is pressed inward from the temporary locking position to the permanent locking position with the terminals looked by their respective bendable lances, the corresponding lance pressing parts enter their respective bend allowing spaces and prohibit the bendable lances from bending, accordingly double locking the terminals. Incidentally, the illustrations of the this, terminal accommodating chambers, bendable lances, bend allowing spaces and lance pressing parts are omitted. However, these components are similar to those shown in FIGS. 1 and 2. In addition, the illustrations of the temporary locking means and permanent locking means are omitted because these means are components which have been already known for this kind of connectors with front holders.

In the case of the connector according to the present embodiment, the front holder 20 is provided with a through-hole 40 penetrating the front holder 20 in the same direction as the front holder 20 is inserted into the housing main body. On the other hand, the front end portion of the housing main body 10 is provided with a rib 30 in a protruding condition, which enters the through-hole 40 of the front holder 20. When the front holder 20 is held in the temporary locking position, the front end 30*a* of the rib 30 agrees with, or juts out from, the rear end surface 20*a* of the front holder 20 which is located rearward in the direction in which the front holder 20 is inserted into the housing main body. Incidentally, the rib 30 juts out from the front end of the hood section 12 arranged around the outer circumferential portion of the housing main body 10.

In the case of the present embodiment, the rib 30 is formed in the shape of a rectangular flat plate. When the font holder 20 is inserted from the temporary locking position to the permanent locking position, a wide external side surface (a guiding surface) 30*b* of the rib 30 and a wide inner side surge (a guiding surface) 40*b* of the through-hole 40 formed in the shape of a slit slidably contact each other. In other words, the operation of inserting the front holder 20 hereto is designed to be guided by a guiding effect brought about by these slidably contacting surfaces (guiding surfaces).

In addition, the housing main body 10 is provided with terminal accommodating sections which are different in specification from each other. For instance, the housing main body 10 is provided with a terminal accommodating section 15A for power supply terminals and a terminal accommodating section 15B for signal terminals. The rib 30 is arranged between the terminal accommodating sections 15A and 15B. Furthermore, the front holder 20 is provided with parts (for example, slots) 25A and 25B corresponding respectively to the terminal accommodating section 15A for the power supply terminals and the terminal accommodating section 15B for the signal terminals. The through-hole 40 is provided between these parts. In other words, the rib 30 separates the terminal accommodating sections 15A and 15B physically.

Figure 4:
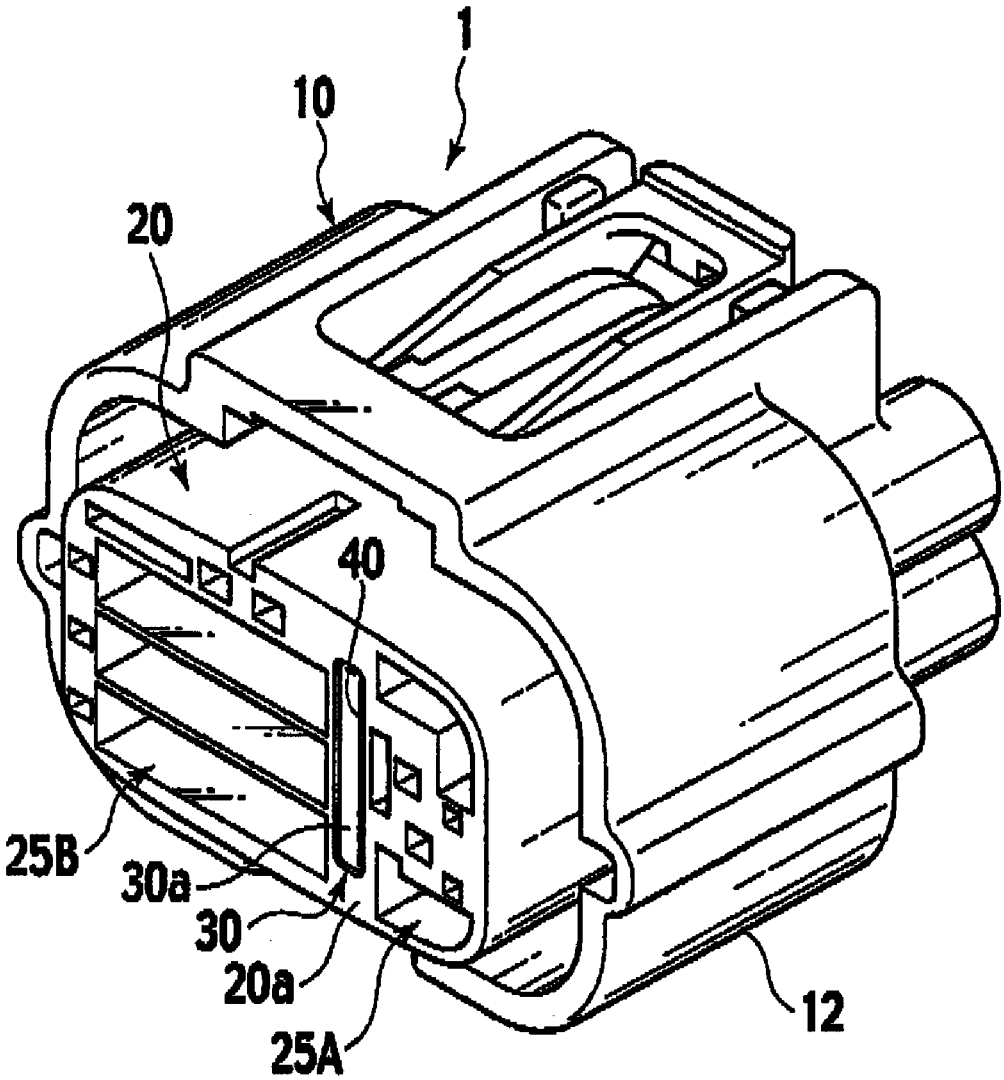
FIG. 4 is a perspective view of the connector, in which a front holder is fitted thereto up to a temporary locking position.

When the front holder 20 and the housing main body 10 are going to be assembled into this connector, first of all, the front holder 20 is inserted into the housing main body 10, and is temporarily locked in the temporary locking position by the temporary locking means (see FIGS. 4 and 5). While the front holder 20 is being temporarily locked in this manner, the front end 30*a* of the rib 30 agrees with, or juts out from, the rear end surface 20*a* of the front holder 20. Even in a case where an article hits the rear end surface 20*a* so that the front holder 20 would otherwise receive a force coming in a direction which inserts the front holder 20 into the housing main body 10, the rib 30 instead receives the force. In other words, the rib 30 is capable of preventing a force from working on the front holder 20. This makes it unlikely that the front holder 20 is inadvertently pressed inward from the temporary locking position to the permanent locking position during its shipment or movement.

Subsequently, while the front holder 20 is being temporarily locked in this manner, this are inserted thereto from the rear of the housing 1A, and are locked by the corresponding bendable lances. Thereafter, the front holder 20 is inserted from the temporary locking position to the permanent locking position by manual pressing or the like. Once done so, the lance pressing parts enter the corresponding bend allowing spaces of the bendable lances, and thus prohibit the bendable lances from bending. Simultaneously with this operation, the front holder 20 is permanently locked to the housing main body 10 by the permanent locking means. Thereby, the connector in which the terminals are double locked is completed.

Figure 8:
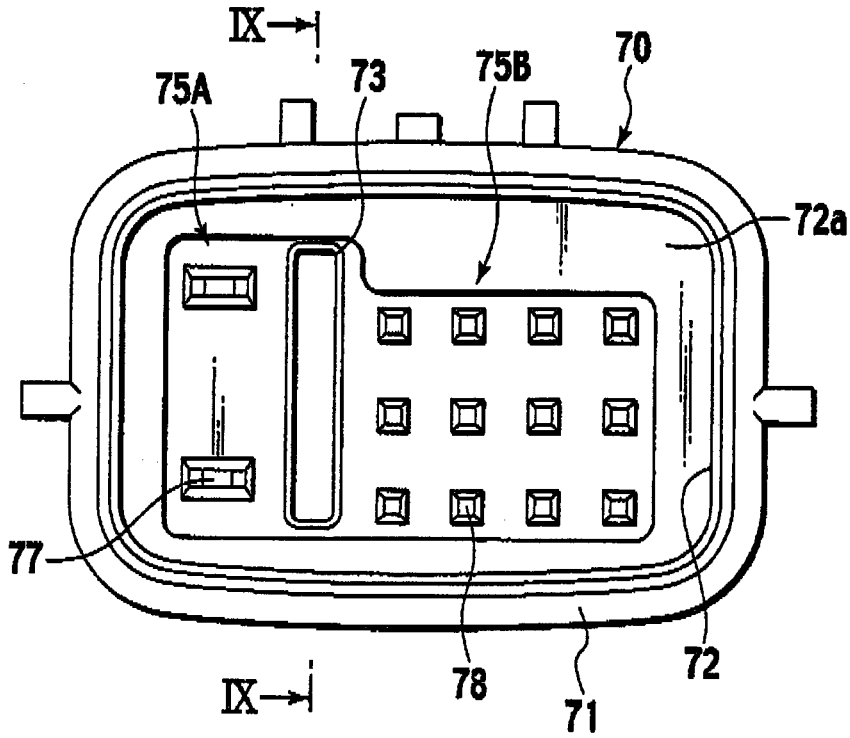
FIG. 8 is a font view of a female connector, which is a counterpart of the male connector.
Figure 9:
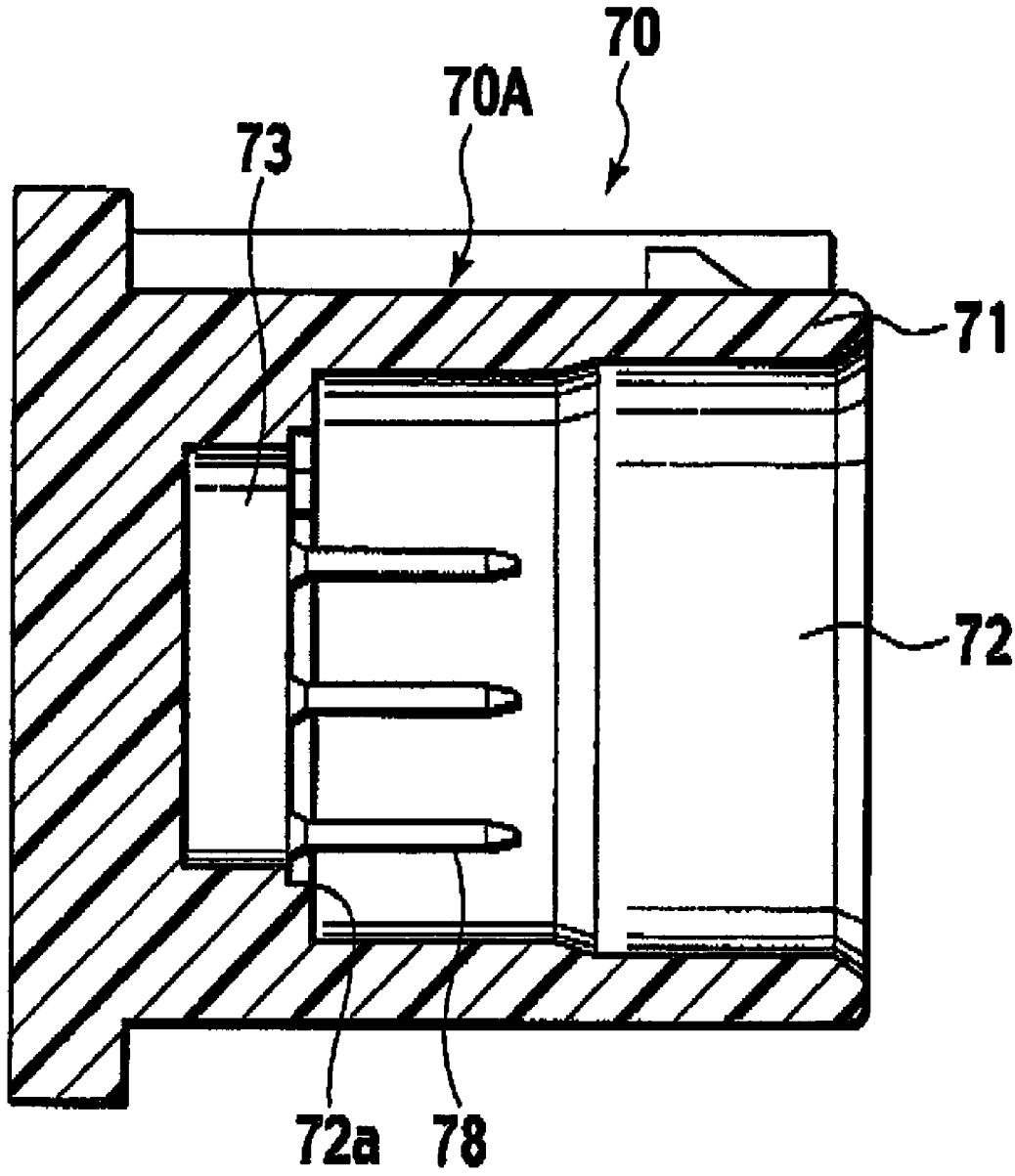
FIG. 9 is a cross-sectional view of the female connector taken along the line IX-IX indicated by an arrow in FIG. 8.

While the front holder 20 is permanently locked in this manner, the front end 30*a* of the rib 30 juts out from the rear end surface 20*a* of the front holder 20, as shown in FIGS. 6 and 7. For this reason, as shown in FIGS. 8 and 9, a female connector 70 which is the counterpart of the connector 1 is provided with a concave portion 73 for receiving the jutting portion of the rib 30. The concave portion 73 is provided in the bottom surface 72*a* of a concave portion 72 formed in a housing 70A.

At this time, a circumferential wall portion denoted by reference numeral 71 in the drawings is guided into a gap between the hood section 12 and the front holder 20, which is shown in FIG. 7, when the female connector 70 and the male connector 1 are fitted to each other. This circumferential wall portion is provided to a recess of the front holder 20, and is brought into intimate contact with an outer circumferential lip of a rubber seal 90 attached to the outer circumference of the cylindrical section 11. This intimate contact maintains a waterproof function of the male and female connectors while the connectors are fitted to each other.

Multiple male terminals 77 for signals and multiple male terminals 78 for the power supply are arranged in the concave portion 72 in the female connector 70 while the terminals are separated into the groups. A group 75A for the power supply terminals is provided to a part which is fitted into the terminal accommodating section 15A for the power supply terminals in the counterpart connector 1 of the connector 70. On the other hand, a group 75B for the signal terminals is provided to a part which is fitted into the terminal accommodating section 15B for the signal terminals in the counterpart connector 1 of tee connector 70. This makes it possible for the rib 30 to separate the electrical connecting system for the power supply and the electrical connecting system for the signals when the male and female connectors are fitted to each other.

As described above, the connector 1 according to the present embodiment, which is shown in FIGS. 3 to 7, is provided in a protruding manner to the front end of the housing main body 10. The length of the rib 30 which enters the through-hole 40 of the front holder 20 while the front holder 20 is being temporarily locked is set at a dimension which causes the front end 30*a* of the rib 30 to agree with, or jut out from, the rear end she 20*a* of the front holder 20. With this setting, assume that an article hits the rear end surface 20*a* of the front holder 20, which is being temporarily locked. Then, a force which would otherwise press the front holder 20 inward works on the front holder 20 in the same direction as the front holder 20 is insert into the housing main body 10. Even in this event, the front end 30*a* of the rib 30 is capable of receiving the force. This makes it possible to prevent the front holder 20 from being inadvertently inserted from the temporary locking position to the permanent locking position.

The above-described effect can be obtained by only providing the housing main body 10 with the rib 30 having the adequate length in a protruding manner, which is capable of being inserted into the through-hole 40 of the front holder 20. In addition, this can be realized by only securing a space for the rib 30. No measures need to be taken for doing things such as extending out the front end of the hood section 12. This can make contributions to constructing the connector 1 in a smaller scale.

In addition, the rib 30 provided in a central portion of the housing main body 10 is capable of receiving an impact of an article. For this reason, no consideration needs to be given to making the opening of the hood section 12 of the front holder 20 smaller. The opening of the hood section 12 is capable of being widened freely. This makes it possible to easily cope with a demand for multi-polar connectors.

Furthermore, because multi-polar connectors can be realized, it is also possible to realize connectors of a hybrid type in which the power supply terminals and the signal terminals are mounted together like the connector according to the present embodiment without difficulties.

Moreover, the holding power for the temporary look need not be set larger in particular. This makes easier work for inserting the front holder to the permanent locking position, and avoids the workability being worsened.

Additionally, the rib 30 and the though-hole 40 are provided with their respective guiding surfaces (the external side surface 30*b* of the rib 30 and the inner side surface 40*b* of the through-hole 40) which slidably contact each other and thereby guide an operation for inserting the front holder 20 into the housing main body 10 while pressing inward the front holder 20 from the temporary locking position to the permanent locking position. This improves the workability with which the front holder 20 is fitted into the housing main body 10 by pressing inward the front holder 20 up to the permanent locking position.

In addition, while the front holder 20 is being permanently locked, the guiding surfaces (the external side surface 30*b* of the rib 30 and the inner side surface 40*b* of the through-hole 40) are always in contact with each other. This contact makes it possible to prevent the front holder 20 and the housing main body 10 form being shaky.

Furthermore, because the rib 30 is designed to jut out from the front end of the hood section 12, it is possible to shorten the length of the hood section 12. This makes it possible to make contributions to construct the connector 1 in a smaller scale.

Moreover, the rib 30 provided to the housing main body 10 physically separates the terminal accommodating section 15A (for the power supply system) and the terminal accommodating section 15B (for the signal system) which are provided to the housing main body 10, and which are different in specification from each other. This separation makes it possible to prevent a leakage from occurring between terminals which are different in specification from each other.

The foregoing embodiment has been described citing the case where the bendable lances are included in the housing main body 10 whereas the lance pressing parts are included in the front holder 20. However, it should be noted that, conversely, the lance pressing parts may be included in the housing main body 10 whereas the bendable lances may be included in the front holder 20.

Additionally, in the case of the foregoing embodiment, the number of the ribs 30 may be one or plural. Specifically, if the ribs 30 are arranged in positions to which an external force is likely to be applied, the ribs 30 we capable of effectively receiving such an unnecessary force which comes in the same direction as the front holder 20 is inserted into the housing main body 10.

What is claimed is:

1. A connector comprising:

a housing main body into which terminals are inserted from a rear of the housing main body, and which includes a rib extending frontward;

a front holder designed to be fitted into the housing main body from a front of the housing main body, and designed to be capable of moving from a temporary locking position, closer to the front of the housing main body, to a permanent locking position away from the front of the housing main body, and the front holder including a through-hole into which the rib is capable of being inserted;

temporarily locking means, provided between the housing main body and the front holder, and configured to temporarily lock the front holder in the temporary locking position;

permanent locking means configured to permanently lock the front holder in the permanent locking position;

bendable lances provided to one of the housing main body and the front holder;

lance pressing parts provided to the other of the housing main body and the front holder; and a hood, provided around an outer circumference of the housing main body, for guiding the insertion of a counterpart connector of the connector, the connector wherein with the front holder existing in the temporary locking position, the bendable lances lock the corresponding terminals which have been inserted into the housing main body from the rear thereof, when the front holder is pressed inward from the temporary locking position to the permanent locking position with the terminals locked by the corresponding bendable lances, the lance pressing parts enter corresponding bend allowing spaces of the bendable lances, and prohibit the corresponding bendable lances from bending, thereby double locking the terminals, and the rib juts out from a front end of the hood frontward of the housing main body.

2. A connector comprising:

a housing main body into which terminals are inserted from a rear of the housing main body, and which includes a rib extending frontward;

a front holder designed to be fitted into the housing main body from a front of the housing main body, and designed to be capable of moving from a temporary locking position, closer to the front of the housing main body, to a permanent locking position away from the front of the housing main body, and the front holder including a through-hole into which the rib is capable of being inserted;

temporarily locking means, provided between the housing main body and the front holder, and configured to temporarily lock the front holder in the temporary locking position;

permanent locking means configured to permanently lock the front holder in the permanent locking position;

bendable lances provided to one of the housing main body and the front holder; and lance pressing parts provided to the other of the housing main body and the front holder, the connector wherein with the front holder existing in the temporary locking position, the bendable lances lock the corresponding terminals which have been inserted into the housing main body from the rear thereof, when the front holder is pressed inward from the temporary locking position to the permanent locking position with the terminals locked by the corresponding bendable lances, the lance pressing parts enter corresponding bend allowing spaces of the bendable lances, and prohibit the corresponding bendable lances from bending, thereby double locking the terminals, the housing main body is provided with a plurality of terminal accommodating sections for accommodating their respective groups of terminals which are different in specification from one group to another, and the rib is arranged between the terminal accommodating sections in order to physically separate the terminal accommodating sections.

* * * * *